United States Patent [19]

Hibbs

[11] Patent Number: 4,551,866

[45] Date of Patent: Nov. 12, 1985

[54] AUTOMATIC TOILET SEAT LOWERING APPARATUS

[76] Inventor: Walter G. Hibbs, 3145 Las Palmas, Houston, Tex. 77027

[21] Appl. No.: 646,366

[22] Filed: Aug. 30, 1984

[51] Int. Cl.[4] ..... A47K 13/10

[52] U.S. Cl. ..... 4/251; 4/236; 4/240; 4/248

[58] Field of Search ..... 4/251, 661, 237, 240, 4/248, 241, 236; 49/265

[56] References Cited

U.S. PATENT DOCUMENTS

| | | | |
|---|---|---|---|
| 1,386,196 | 8/1921 | Munn | 4/251 UX |
| 2,440,232 | 4/1948 | Davidson | 4/251 X |
| 2,563,095 | 8/1951 | Beyrodt | 4/251 |
| 2,772,422 | 12/1956 | Knudsen | 4/251 |
| 3,303,517 | 2/1967 | Wood et al. | 4/251 |
| 3,516,095 | 6/1970 | Clifton et al. | 4/251 |
| 3,528,075 | 9/1970 | Leon | 4/251 |
| 4,103,371 | 8/1978 | Wilson | 4/251 |

FOREIGN PATENT DOCUMENTS

| | | | |
|---|---|---|---|
| 827394 | 2/1960 | United Kingdom | 4/251 |

*Primary Examiner*—Henry K. Artis

*Attorney, Agent, or Firm*—Dodge, Bush & Moseley

[57] ABSTRACT

Apparatus for automatically returning a hinged toilet seat to the lower horizontal position after use of the toilet as a urinal by a male. An operating cylinder is easily attached to the toilet by an adjustable mounting system. A piston is reciprocally disposed in the cylinder and operably linked by a pivoting lever mechanism to the pivoted toilet seat. Movement of the toilet seat to the upper position actuates a biasing spring to urge the piston to move to return the seat to the lower position. The biased piston movement is retarded by operating fluid in the cylinder to delay closing until the male user is finished.

5 Claims, 2 Drawing Figures

AUTOMATIC TOILET SEAT LOWERING APPARATUS

BACKGROUND OF THE INVENTION

1. Field of the Invention

This invention relates broadly to the field of automatic closure devices and in particular to a closure device for automatically returning a toilet seat to the lower position.

2. Description of the Prior Art

Automatic toilet seat closure devices are known in the prior art. Many of these art devices are complex, difficult to install and require special adaptation equipment to fit conventional toilets.

U.S. Pat. No. 1,590,298 to Landis discloses a toilet seat operating mechanism that is secured to the floor with the seat moved to the upper position by operation of a foot peddle. Selective operation of the foot peddle will move the hinged cover and seat to either go over dead center or be positioned at less than dead center. If not over dead center, gravity will return the seat to the lower position with the seal cushioned against sudden impact on its return by a piston and cylinder arrangement. The disclosed device in pneumatically operated and will return the toilet seat to the closed position from the over dead center position after the toilet has been used for urinal purposes by a male user.

U.S. Pat. No. 2,236,466 to Cashwell discloses a toilet seat closure that is automatically closed upon opening the door to exit the room in which the toilet is located.

U.S. Pat. No. 3,516,095 to Clifton et al discloses a double acting lowering and lifting attachment for a toilet seat. The foot peddle operated mechanism serves to either raise or lower the seat. In lowering the seat, the foot peddle moves the seat over dead center in order that gravity then will move the seat to the closed position with a buffering mechanism to mitigate the seat impact.

U.S. Pat. No. 3,528,075 to Leon is entitled "Device For Raising The Seat Of A Closet". The apparatus may also be used to lock the seat in the upper position. The foot peddle actuation will also serve to lower the seat when desired.

In Brown Pat. No. 2,088,050, an automatic operating mechanism is provided in which the seat tends to fall into the closed position under the influence of gravity due to the weight of the seat and the operating lever.

In Boston Pat. No. 2,636,185, an automatic toilet seat lifter is disclosed that raises the seat to the vertical position when not in use. A similar operating mechanism is disclosed in U.S. Pat. No. 2,772,422 to Knudsen. A floor mounted lifting device is also disclosed in Fields Pat. No. 3,504,385. The Fields' seat is lowered by gravity and is regulated by a hydraulic cylinder. A variation of this type of sea lifting device is disclosed in U.S. Pat. No. 4,103,371 to Wilson.

A "Sterilized Toilet Seat" is disclosed in Beyrodt Pat. No. 2,563,095. The power operated seat is automatically sterilized in the vertical position. The seat is lowered for use by operation of a solenoid and returns to the vertical sterilizing position by a spring arrangement after use. In Warner U.S. Pat. No. 2,473,082, a toilet seat lifter arrangement using hand actuated levers for the seat and cover is disclosed. An air piston arrangement dampens movement of the seat and cover to prevent the seat from slamming shut.

SUMMARY OF THE INVENTION

The present invention relates to the field of an automatic toilet seat lowering device. In particular, the present invention provides a relatively inexpensive automatic seat lowering device that may be easily mounted and installed on conventional toilets. The device is automatically actuated when the toilet seat is raised for use as a male urinal as a spring biases a piston operatively connected to the toilet seat to return the seat to the lower position. A piston is disposed within a cylinder filled with a suitable operating fluid which dampens or retards the movement of the piston against the spring biasing. The piston is provided with a flow port of predetermined size to control the passage of operating fluid and therefore the delay in lowering of the seat until after its use as a male urinal is completed.

DESCRIPTION OF THE PREFERRED EMBODIMENT

Figure 1:
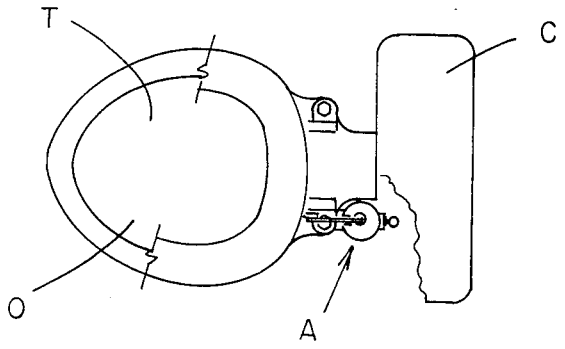
FIG. 1 is a top view of a conventional toilet illustrating the installed position of the automatic toilet seat lowering device of the present invention.

FIG. 1 is a top view of a conventional toilet T having an upwardly facing bowl or opening O and water closet C. The bowl opening O terminates in an upwardly facing substantially horizontal annular shoulder H (FIG. 2) in the usual manner. The water closet C is mounted for use with the toilet T in the conventional manner and is illustrated for showing the installed position of the automatic toilet seat lowering apparatus, generally designated A, of the present invention.

The toilet T is provided with the conventional hinged user seat S and lid (not illustrated). Conventionally, the lid is provided with a separate pivoting arrangement from the seat S although the same hinged pintle P may be used as used for both the seat S and lid. The pintle or pivot pin P is carried or supported by a bracket B that is mounted to the upwardly facing substantially horizontal surface H by helically threaded bolts M secured by a conventional nut N and washer W arranged in the usual manner.

Figure 2:
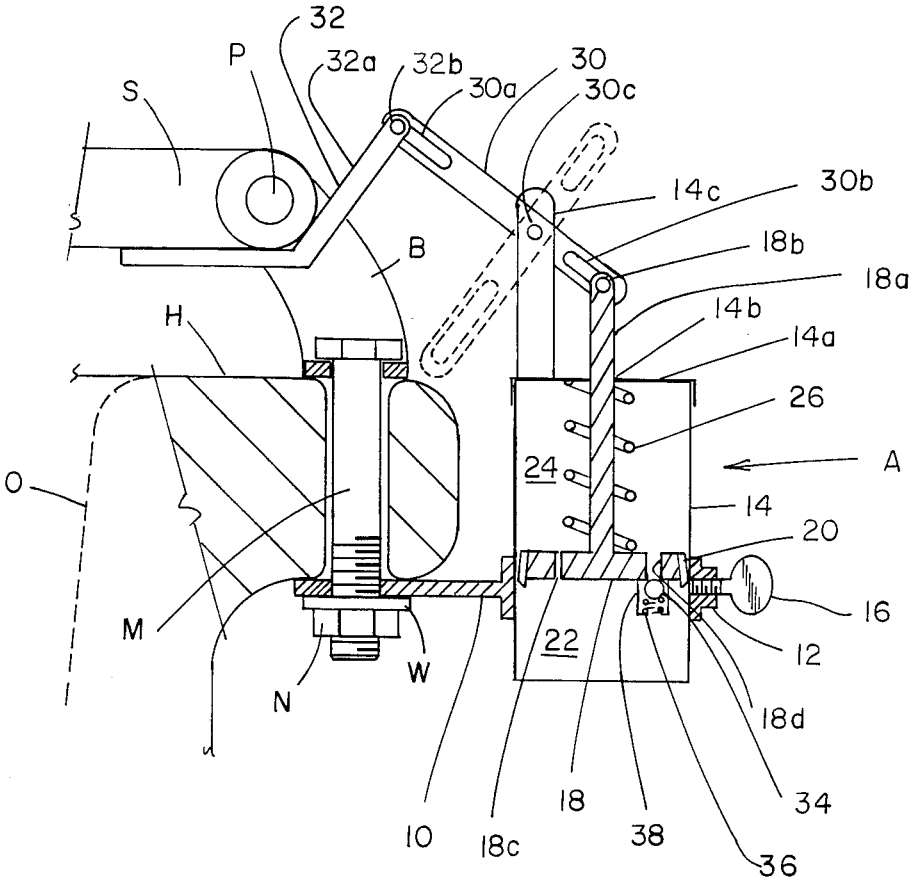
FIG. 2 is a side view partially in section of the automatic toilet seat lowering device operably connected to the toilet seat.

The automatic toilet seat lowering apparatus A is illustrated in FIG. 2 operably attached to the toilet T. A slotted metal bracket 10 is secured to the bolting M by nut N, washer W and toilet T in the conventional manner. A conventional longitudinally extending slot (not illustrated) is provided on the mounting bracket 10 to enable adjustment of the spacing of the apparatus A from the toilet seat S. A suitable circular clamp 12 is formed at one end of the bracket 10 for receiving and securing a cylinder 14 therein. An adjustable thumbscrew 16 on the bracket enables proper vertical positioning of the cylinder 14 relative to the toilet seat S. The closed lower and cylinder 14 is secured by the clamp 12 and includes a removable cover **14*a* having a central opening 14*b*** formed therethrough.

Disposed within the cylinder 14 is a movable operating piston 18 having a piston rod **18*a* extending upwardly therefrom and having a portion of the piston rod extending through the aperture 14*b* exteriorly of the cylinder 14. The piston 18 mounts a seal ring 20 for effecting a desired seal between the piston 18 and the cylinder 14 in the conventional manner for forming a lower expansible chamber 22 below the piston 18 and an upper expansible chamber 24 above piston 18. A coiled biasing spring 26 is disposed in the upper expansible chamber 24 for engaging the piston 18 and the cap 14***a* of the cylinder for urging the piston 18 to its lowermost position illustrated in FIG. 2.

In order to effect the automatic toilet seat lowering, it is necessary to operably connect the exterior portion of the piston rod 18*a* to the toilet seat S. This is accomplished by link member 30 and toilet seat attachment bracket 32. Attachment member 32 is secured to the toilet seat S by a suitable means such as glueing or by wood screws (not illustrated). The attachment member 32 has an upwardly extending portion 32*a* angled to provide pivoting clearance for the seat S and having a pivot pin 32*b* mounted thereon. The pivot pin 32*b* is received in a slot 30*a* of the link member 30 for operably connecting the members 30 and 32. A similar pivot pin 18*b* mounted on the exterior portion of the piston rod extension 18*a* is received in a slot 30*b* on the other end of the link member 30 to operably connect the piston 18 with the link member 30. The cylinder cap 14*a* provides an upwardly extending support 14*c* that pivotally connected to the link member 30 by pin 30*c* for providing the pivot point for the link 30. The link member 30 is then moved from the position illustrated in FIG. 2 when the seat S is in the lower position to the position illustrated in phantom when the seat S is raised to the upper substantially vertical position. Thus, when the seat S is in the lower substantially horizontal position, the link member 30 positions the piston 18 in the lower position. As the seat S is moved to the upper substantially vertical position when the toilet T is used as a urinal by a male, the piston 18 is pulled or reciprocated upwardly and thereby automatically compressing spring 26.

When the piston 18 is the upper position, the spring 26 tends to urge or bias to return the piston to the lower position and the seat S to the substantially horizontal lower position also. To retard this movement of the piston until after the user is finished, the expansible chambers 22 and 24 are filled with a suitable operating fluid. The piston 18 is provided with a first flow port 18*c* which controls communication of the operating fluid between the lower expansible chamber 22 and the upper expansible chamber 24. By proper sizing of the flow port 18*c*, the speed with which the piston 18 will move to the lower position by the spring 26 is controlled by the size of the flow port 18*c*. With proper balancing of the strength of the spring 26 and the size of the flow port 18*c*, the delay in automatically returning the toilet seat to the lower position can be controlled.

Normally, the toilet seat S is raised to the upper substantially vertical position at a much greater speed than is desired for the seat S to close. To compensate for this faster movement, either or both of two things may be done. The seal 20 of the piston with the cylinder 14 may be made such that upon upward movement of the piston 18, the seal 20 will bypass or vent the operating fluid to enable leakage about the piston 18 from the upper expansible chamber 24 into the lower expansible chamber 22. Such bypass flow may also be accomplished by providing a second flow port 18*d* with a flow check valve such as provided by ball 34 biased by spring 36 retained in housing 38. When the piston 18 moves rapidly to the upper position, the ball 34 is spaced from the second flow part 18*d* to enable passage of fluid therethrough. When the piston 18 reaches the upper position, the spring 36 urges the ball 34 back into engagement with the port 18*d* for blocking flow of fluid from the lower expansible chamber 22 into the upper expansible chamber 24 and retarding movement of the piston 18 by requiring all of the operating fluid to flow through the port 18*c*.

USE AND OPERATION OF THE PRESENT INVENTION

In the use and operation of the present invention, the apparatus A is mounted to the conventional toilet T in the manner illustrated. The use of the bracket 10 and adjustable clamp 12 enable the apparatus A to be used on any conventional toilet T without the need for special toilets, tools or adapters. The cylinder 14 is filled with the suitable operating fluid and the cap 14*a* placed in position. The link member 30 is then reconnected to the piston rod 18*a* and the seat attachment 32.

When the toilet seat S is raised, the piston 18 is moved to the upper position (not illustrated) compressing the spring 26. During such movement, the water in the upper expansible chamber 24 is enabled to flow into the lower expansible chamber 22 through the first flow port 18*c* as well as the second flow port 18*d* due to the movement of the ball 34. The seal 20 also operates to bypass fluid in the manner previously described to enable the seat S and piston 18 to be moved rapidly to the upper position. When the piston 18 reaches the upper position the seal 20 reestablishes the leakage blocking relationship with the cylinder 14 while the ball 34 is moved by the spring 36 to close the second flow port 18*d*. Operating fluid can then only be displaced from the lower expansible chamber 22 by flowing through the flow port 18*c* into the upper expansible chamber 24. The fluid trapped in the lower expansible chamber 22 will retard the urging of the spring 26 a sufficient amount of time to enable the use of the toilet T as a urinal before sufficient movement travel of the piston 18 to automatically lower the toilet seat S.

The present invention provides a relatively inexpensive apparatus for automatically lowering toilet seat and may be installed quickly on existing conventional toilets. By making the cylinder 14 and the piston 18 of a suitable molded plastic such as molded polyethylene an inexpensive apparatus is provided.

The foregoing disclosure and description of the invention are illustrative and explanatory thereof, and various changes in the size, shape and materials, as well as in the details of the illustrated construction may be made without departing from the spirit of the invention.

What is claimed is:

1. Apparatus for automatically returning a hinged toilet seat to the lower substantially horizontal position after raising to an upper substantially vertical position after passage of a predetermined amount of time, including:

a cylinder;

means for releasably securing said cylinder to a toilet bowl at a desired location;

a piston sealingly disposed in said cylinder for reciprocal movement therein, said piston forming a piston rod having a portion extending from said cylinder;

means for operably linking said portion of said piston rod extending from said cylinder to the hinged toilet seat for moving said toilet seat from the substantially vertical upper position to the lower substantially horizontal position;

biasing means disposed to end said cylinder for urging said piston to move in a direction for operably moving the toilet seat to the lower substantially horizontal position;

said cylinder filled with an operating fluid having preselected flow properties;

said piston having a first flow port formed therethrough to enable passage of operating fluid therethrough at a desired rate to control the speed of movement of said piston from moving the toilet seat to the lower substantially horizontal position.

2. The apparatus as set forth in claim 1 including:

said piston having a seal ring for slidably sealing with said cylinder.

3. The apparatus as set forth in claim 2, wherein:

said seal ring bypassing said operating fluid when said piston moves in response to movement of said seat to the upper substantially vertical position, said seal ring responsive to movement of said piston means by said biasing means for sealing said piston with said cylinder for directing flow of said operating fluid through said first flow port.

4. The apparatus as set forth in claim 1, wherein:

said piston having a second flow port formed therethrough;

a check valve disposed in said second flow port for blocking the flow of said operating fluid through said second flow port when said biasing spring moves said piston to move the toilet seat to the lower substantially horizontal position, said check valve moving to the open position for passing sufficient operating fluid to enable rapid movement of said piston when the toilet seat is moved from the lower substantially horizontal position to the upper substantially vertical position.

5. The apparatus as set forth in claim 1, wherein:

said cylinder and said piston are molded from a lightweight plastic.

* * * * *